US008141683B1

(12) United States Patent
Wurth et al.

(10) Patent No.: US 8,141,683 B1
(45) Date of Patent: Mar. 27, 2012

(54) EXPANDABLE PLATFORM

(75) Inventors: Steven P. Wurth, Sylvania, OH (US); Terry Rodebaugh, Whitehouse, OH (US); Jeffrey A. Wagenhauser, Lambertville, MI (US)

(73) Assignee: Wurtec Elevator Products & Services, Toledo, OH (US)

( * ) Notice: Subject to any disclaimer, the term of this patent is extended or adjusted under 35 U.S.C. 154(b) by 166 days.

(21) Appl. No.: 12/766,951

(22) Filed: Apr. 26, 2010

Related U.S. Application Data

(60) Provisional application No. 61/174,001, filed on Apr. 30, 2009.

(51) Int. Cl.
*E04G 1/00* (2006.01)
*B66B 9/00* (2006.01)

(52) U.S. Cl. ..... 182/223; 187/414

(58) Field of Classification Search ..... 182/223; 187/441; 108/54.1
See application file for complete search history.

(56) References Cited

U.S. PATENT DOCUMENTS

| | | | | |
|---|---|---|---|---|
| 2,379,553 | A | 7/1945 | Tilton | |
| 2,739,776 | A * | 3/1956 | Terando | 108/54.1 |
| 2,873,934 | A * | 2/1959 | Settles | 108/54.1 |
| 2,909,350 | A * | 10/1959 | Morris | 108/54.1 |
| 4,345,671 | A | 8/1982 | Tosato et al. | |
| 4,619,346 | A | 10/1986 | Deguerry | |
| 5,065,843 | A | 11/1991 | Richards | |
| 5,230,404 | A | 7/1993 | Klein | |
| 5,299,819 | A * | 4/1994 | Leu | 280/260 |
| 5,785,293 | A * | 7/1998 | Ford et al. | 248/649 |
| 6,076,692 | A * | 6/2000 | Avot | 220/8 |
| 6,164,418 | A | 12/2000 | Chen et al. | |
| 7,108,100 | B2 | 9/2006 | Stingl | |
| 2007/0089936 | A1 | 4/2007 | Zeng et al. | |

* cited by examiner

*Primary Examiner* — Alvin Chin Shue
(74) *Attorney, Agent, or Firm* — MacMillan, Sobanski & Todd, LLC

(57) ABSTRACT

An expandable platform for use within an elevator hoistway is provided. The expandable platform includes a plurality of corner members slidably connected to a plurality of side members. The corner members and the side members form an adjustable frame assembly. A plurality of extension members is connected to opposing side members. The extension members are configured to support a plurality of support surfaces. A depth and a width of the adjustable frame assembly can be adjusted to fit elevator hoistways having various depths and widths.

9 Claims, 6 Drawing Sheets

Fig. 1
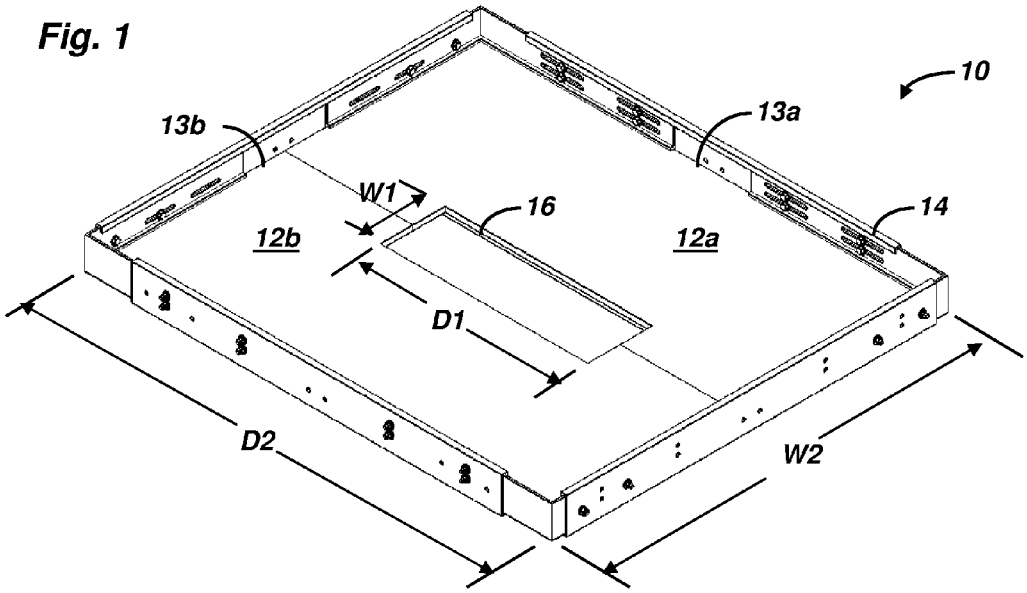
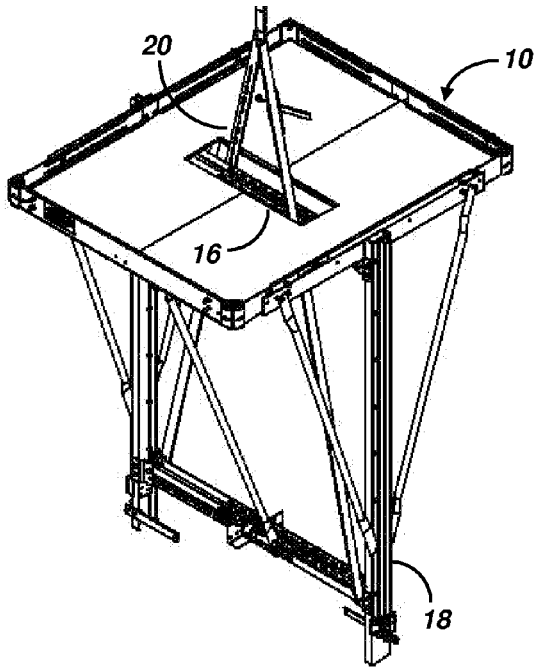
Fig. 2

Fig. 4
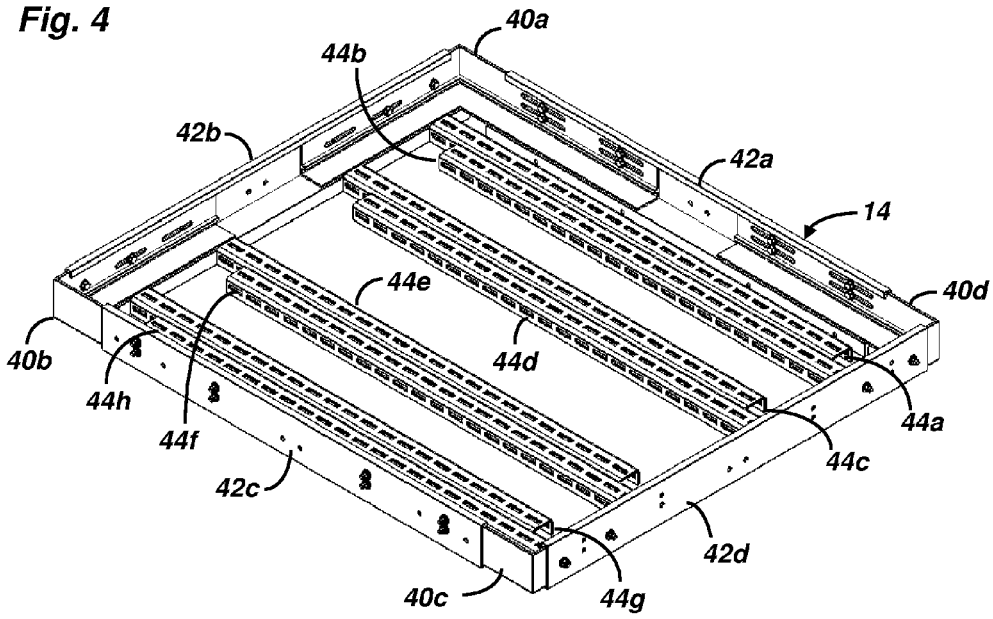
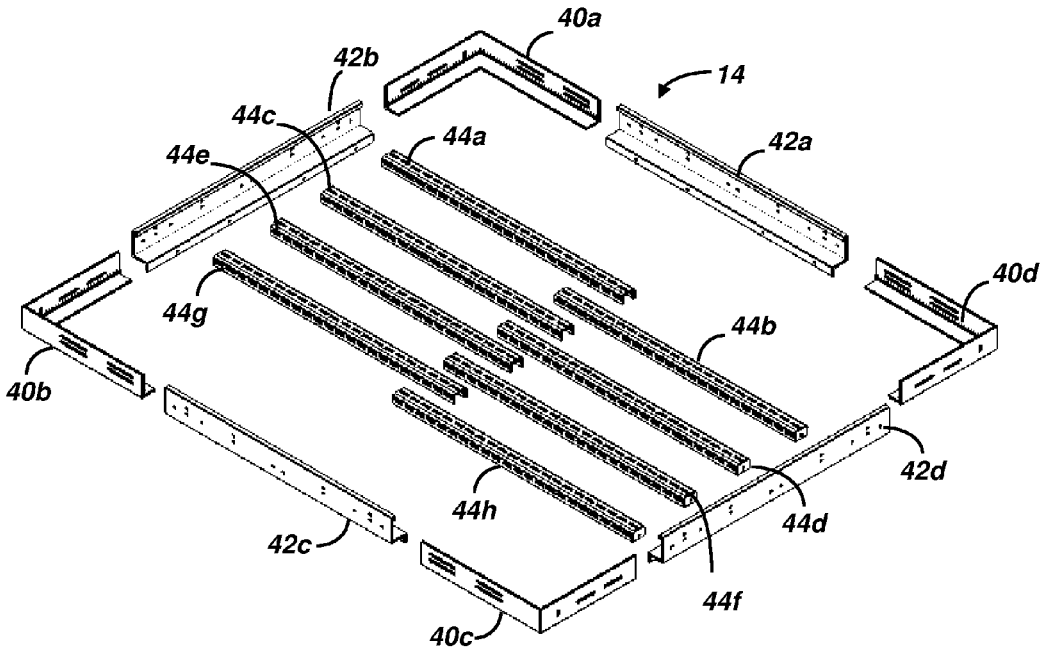
Fig. 5

EXPANDABLE PLATFORM

RELATED APPLICATIONS

This application claims the benefit of U.S. Provisional Application No. 61/174,001, filed Apr. 30, 2009, the disclosure of which is incorporated herein by reference.

BACKGROUND OF THE INVENTION

This invention relates in general to the construction of structures, such as for example commercial buildings. More specifically, this invention relates to a construction apparatus that can be used within an elevator hoistway.

Structures, such as commercial buildings, can be built using a variety of construction methods. One example of a common construction method is to erect building floors and an elevator hoistway and then install an elevator within the elevator hoistway. In this construction method, a temporary working platform is used within the elevator hoistway to install the elevator. The working platform is moved from one building floor to another building floor as work within the elevator hoistway is completed. While positioned in the elevator hoistway, the working platform can be attached to a variety of temporary construction structures. One example of a temporary construction structure is called a "false car". The purpose of the false car is to support the temporary working platform as the platform moves through the elevator hoistway.

Elevators can have varying widths, depths, and capacities. Accordingly, the elevator hoistways supporting the elevators can have varying dimensions to accommodate the varying widths, depths and capacities of the elevators. It would be advantageous to provide an expandable platform to accommodate the varying dimensions of elevator hoistways for use as a temporary working platform.

SUMMARY OF THE INVENTION

The above objects as well as other objects not specifically enumerated are achieved by an expandable platform for use within an elevator hoistway. The expandable platform includes a plurality of corner members slidably connected to a plurality of side members. The corner members and the side members form an adjustable frame assembly. A plurality of extension members is connected to opposing side members. The extension members are configured to support a plurality of support surfaces. A depth and a width of the adjustable frame assembly can be adjusted to fit elevator hoistways having various depths and widths.

According to this invention there is also provided an expandable platform for use within an elevator hoistway. The expandable platform includes a plurality of corner members slidably connected to a plurality of side members. The corner members and the side members form an adjustable frame assembly. The plurality of corner members is configured as assemblies of corner brackets and rails. A plurality of extension members are connected to opposing side members. The extension members are configured to support a plurality of support surfaces. A depth and a width of the adjustable frame assembly can be adjusted to fit elevator hoistways having various depths and widths.

According to this invention there is also provided methods of using an expandable platform within an elevator hoistway. The methods include the steps of providing an expandable platform having a plurality of corner members slidably connected to a plurality of side members, the corner members and the side members forming an adjustable frame assembly, connecting a plurality of extension members to the adjustable frame assembly, the extension members configured to support a plurality of support surfaces and adjusting a depth and a width of the adjustable frame assembly such that the adjustable frame assembly fits the depth and width of the elevator hoistway.

Various objects and advantages of the expandable platform will become apparent to those skilled in the art from the following detailed description of the preferred embodiment, when read in light of the accompanying drawings.

BRIEF DESCRIPTION OF THE DRAWINGS

FIG. 1 is a perspective view of an expandable platform that can be used within an elevator hoistway.

FIG. 2 is a perspective view of the expandable platform illustrated in FIG. 1 mounted to a false car.

FIG. 4 is a perspective view of the expandable platform illustrated in FIG. 1 shown without work surfaces.

FIG. 5 is an exploded perspective view of the expandable platform illustrated in FIG. 4.

DETAILED DESCRIPTION OF THE INVENTION

Figure 3:
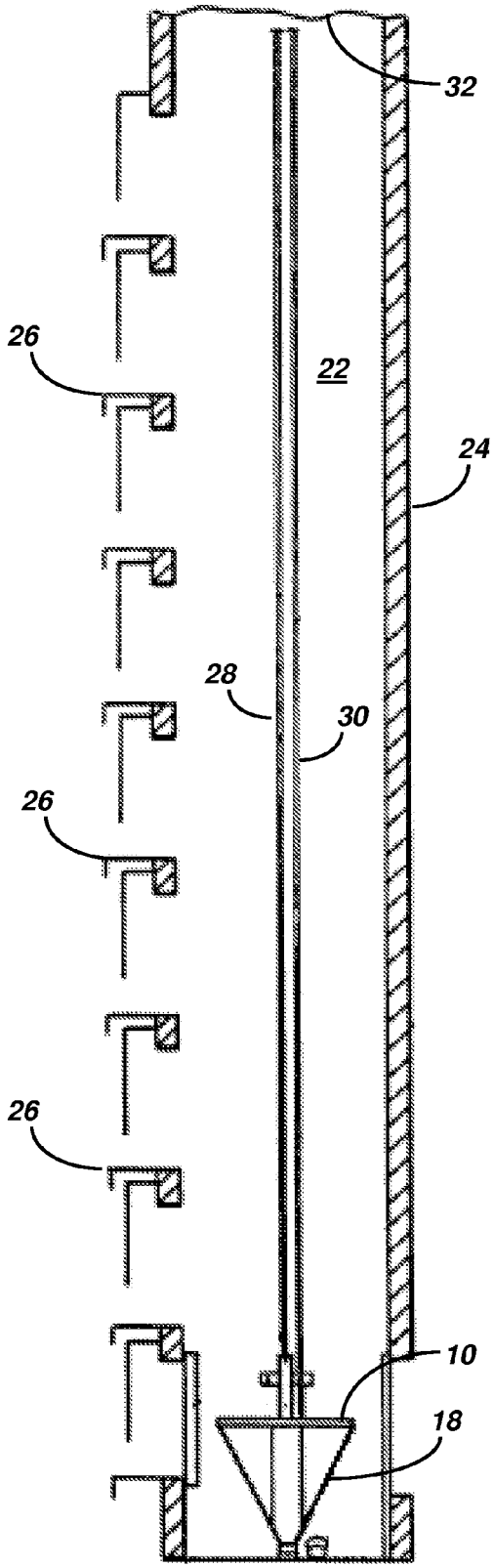
FIG. 3 is a side view in elevation of an elevator hoistway illustrating the false car and expandable platform of FIG. 2.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Referring now to the drawings, there is illustrated in FIG. 1 an expandable platform, indicated generally at 10, for use within an elevator hoistway of a building. The term "platform", as used herein, is defined to mean a decklike construction. The term "expandable", as used herein, is defined to mean having the capacity to increase in size. The term "elevator hoistway", as used herein, is defined to mean a space enclosed by walls and elevator doors for the travel of one or more elevators, dumbwaiters or material lifts. The term "false car", as used herein, is defined to mean a temporary construction structure, for use within an elevator hoistway, which is configured to be vertically hoisted within the elevator hoistway and provide support for personnel working within the elevator hoistway.

The expandable platform 10 includes platform surfaces 12*a* and 12*b* supported by a frame assembly 14. The platform surfaces 12*a* and 12*b* are removable and configured to provide a supporting surface for personnel working within an elevator hoistway. In the illustrated embodiment, the platform surfaces 12*a* and 12*b* are made of plywood and have a thickness of approximately 0.75 inch. However, the platform surfaces 12*a* and 12*b* can be made of other desired materials, such as for example aluminum, and can have other desired thicknesses. Optionally, the platform surfaces 12*a* and 12*b* can have any desired surface coating or finish, including the non-limiting example of a non-skid coating.

In certain embodiments, the platform surfaces 12*a* and 12*b* cooperate to form an opening 16. The opening 16 has a depth D1 and a width W1. In the illustrated embodiment, the depth D1 is approximately 16.0 inches and the width W1 is approximately 6.0 inches. In other embodiments, the depth D1 can be more or less than approximately 16.0 inches and the width W1 can be more or less than approximately 6.0 inches. While the embodiment illustrated in FIG. 1 shows an opening 16, it should be appreciated that in other embodiments, the platform surfaces, 12*a* and 12*b*, do not form an opening.

Referring again to FIG. 1, the expandable platform 10 has an adjustable platform depth D2 and an adjustable platform width W2. Generally, the expandable platform 10 is configured to adjust the platform depth D2 and/or the platform width W2 to accommodate the length and width of an elevator hoistway within which the expandable platform 10 is to be used. In the illustrated embodiment, the platform depth D2 is in a range of from about 72.0 inches to about 96.0 inches and the platform width W2 is in a range of from about 61 inches to about 75 inches. Alternatively, the platform depth D2 can be less than about 72.0 inches or more than about 96.0 inches and the platform width W2 can be less than about 61.0 inches or more than about 75.0 inches.

Referring now to FIG. 2, the expandable platform 10 can be attached to a temporary construction structure for use within an elevator hoistway. In the illustrated embodiment, the expandable platform 10 is attached to a false car 18. The illustrated false car 18 includes a hoist frame 20 configured to attach the false car 18 to hoisting apparatus (not shown). The opening 16 of the expandable platform 10 is configured to allow the hoist frame 20 to extend through the expandable platform 10. The false car 18 can have any desired structure.

Referring now to FIG. 3, the false car 18 having the attached expandable platform 10 is illustrated within an elevator hoistway 22 of a building 24. The building 24 includes a plurality of building floors 26. While the building 24 illustrated in FIG. 3 is shown having nine building floors 26, it should be understood that the building 24 can have more or less than nine building floors 26. The elevator hoistway 22 and the building floors 26 can have any suitable design and can be made from any desired materials.

As shown in FIG. 3, a first line 28 and a second line 30 extend from a hoistway top 32 in a downward direction within the elevator hoistway 22 to the false car 18. The first line 28 is configured as a hoisting line for vertically moving the false car 18 within the elevator hoistway 22. The second line 30 is configured as a safety line for the false car 18. In operation, the false car 18 is moved vertically within the elevator hoistway 18 thereby providing supporting surfaces for personnel working within the elevator hoistway 18. The false car 18 can be moved vertically within elevator by any desired hoisting device (not shown).

While the embodiment shown in FIG. 3 illustrates the expandable platform 10 mounted to a false car 18, it should be understood that the expandable platform 10 can be mounted to any desired structure or device for use within the elevator hoistway 22. Examples of other structures or devices for use within the elevator hoistway 22 include, but are not limited to, hoistway support beams and elevator car frame cross-heads. In still other embodiments, the expandable platform 10 can be used without a supporting structure. In these embodiments, the expandable platform 10 can be connected to hoist lines and vertically moved throughout the elevator hoistway 22. The expandable platform 10 can then be supported by suitable temporary connections with the elevator hoistway 22, such as for example with the divider beams or other structural members forming the elevator hoistway 22.

Referring now to FIGS. 4 and 5, the frame assembly 14 of the expandable platform 10 is shown. The frame assembly 14 includes corner members 40*a*-40*d*, side members 42*a*-42*d* and extension members 44*a*-44*h*. Generally, the side members 42*a*-42*d* are configured to slidably attach to the corner members 40*a*-40*d*, thereby allowing adjustment of the depth D2 and the width W2 of the expandable platform 10.

Figure 6:
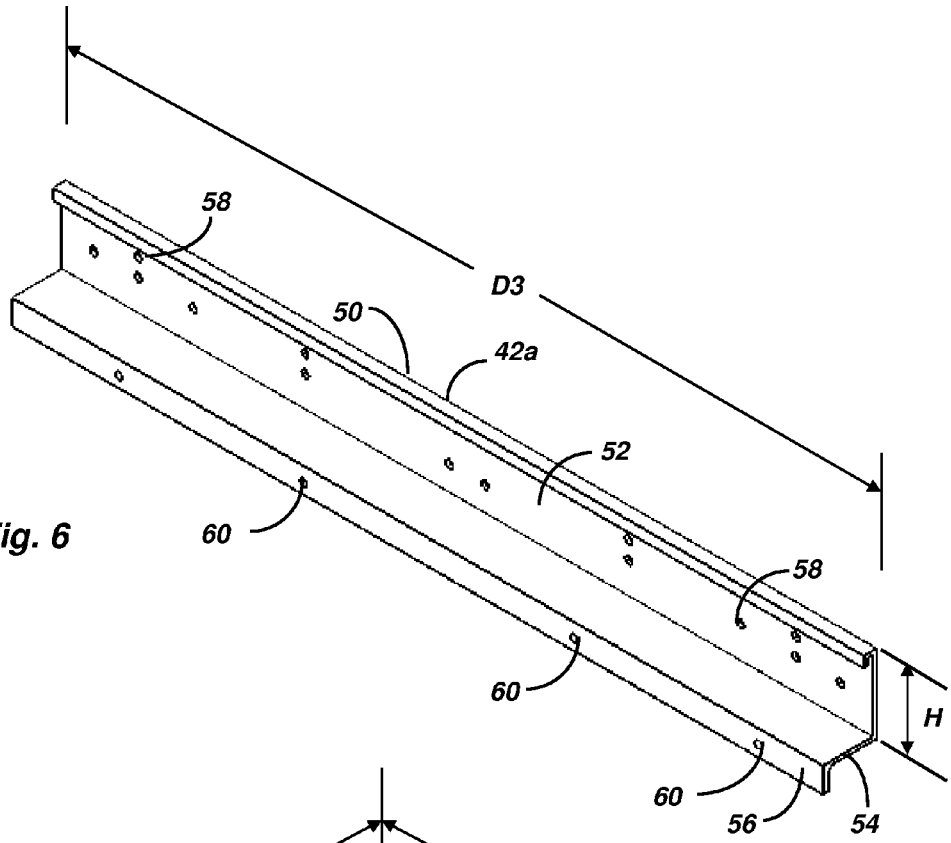
FIG. 6 is a perspective view of a side member of the expandable platform illustrated in FIG. 5.

Referring now to FIG. 6, the side member 42*a* is illustrated. While all of the illustrated side members 42*a*-42*d* can be the same, for purposes of simplicity, only side member 42*a* is shown in FIG. 6 and discussed below. The side member 42*a* has a depth D3. In the illustrated embodiment, the depth D3 of the side member 42*a* is in a range of from about 50.0 inches to about 80.0 inches. In other embodiments, the depth D3 of the side member 42*a* can be less than about 50.0 inches or more than about 80.0 inches. The side member 42*a* includes a lip 50, a kick surface 52, a support surface 54 and an attachment surface 56. The kick surface 52 includes a plurality of spaced apart apertures 58 and the attachment surface 56 includes a plurality of spaced apart apertures 60. The kick surface 52 has a height H. In the illustrated embodiment the height H of the kick surface 56 is approximately 4.0 inches. However, in other embodiments, the height H of the kick surface 56 can have any desired height.

In the embodiment shown in FIG. 6, the lip 50 and the attachment surface 56 are continuous structures that span the depth D3 of the side member 42*a*. In other embodiments, the lip 50 and the attachment surface 56 can be discontinuous structures and the discontinuous structures can have lengths that are less than the depth D3.

Figure 7:
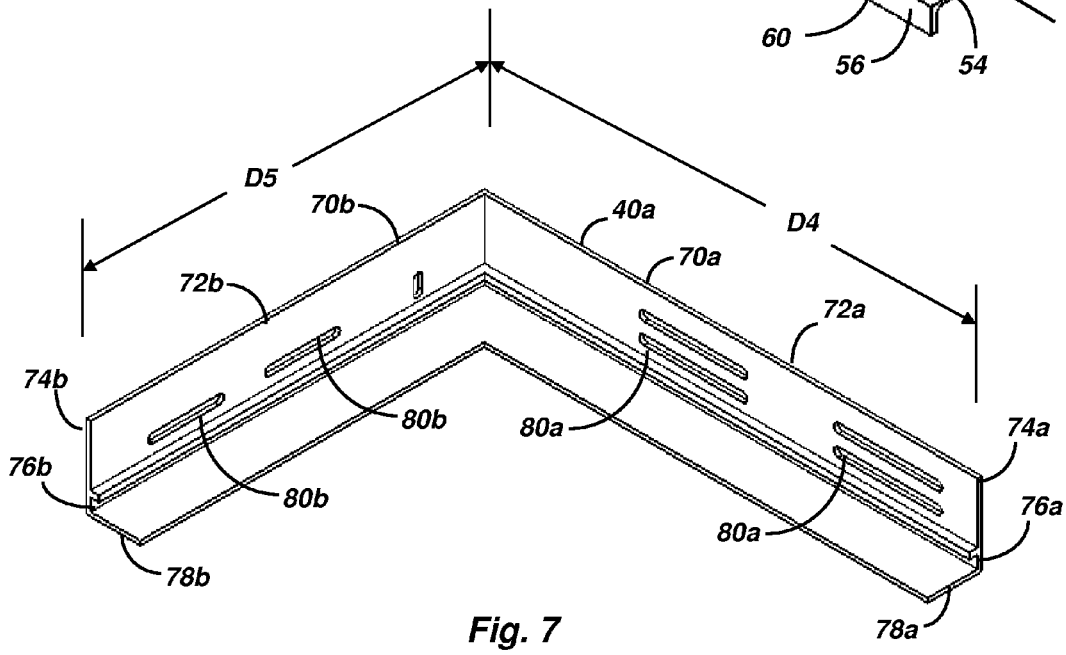
FIG. 7 is a perspective view of a corner member of the expandable platform illustrated in FIG. 5.

Referring now to FIG. 7, the corner member 40*a* is illustrated. While all of the illustrated corner members 40*a*-40*d* can be the same, for purposes of simplicity, only corner member 40*a* is shown in FIG. 7 and described below. The corner member 40*a* includes a first side 70*a* connected to a second side 70*b*. The first side 70*a* has a depth D4 and the second side 70*b* has a depth D5. In the illustrated embodiment, the depths D4 and D5 are in a range of from about 10.0 inches to about 30.0 inches. In other embodiments, the depths D4 and D5 can be less than about 10.0 inches or more than about 30.0 inches. While the embodiment illustrated in FIG. 7 and the description provided above describe the depths D4 and D5 to be approximately the same, it should be appreciated that in certain embodiments, the depths D4 and D5 can be different from each other.

The first and second sides, 70*a* and 70*b*, include respective top edges, 72*a* and 72*b*, vertical members 74*a* and 74*b*, lips 76*a* and 76*b*, and horizontal members 78*a* and 78*b*. The vertical member 74*a* includes slots 80*a* and the vertical member 74*b* includes slots 80*b*. In the illustrated embodiment, the corner member 40*a* having first and second sides, 70*a* and 70*b*, is formed as a one-piece structure. However, as will be described in more detail below, the corner member 40*a* can be assembled from multiple component structures.

In the embodiment shown in FIG. 7, the lips 76*a* and 76*b* are shown as continuous structures that span the depths D4 and D5 of the first and second sides 70*a* and 70*b*. In other embodiments, the lips 76*a* and 76*b* can be discontinuous structures and the discontinuous structures can have depths that are less than the depths D4 and D5.

Figure 8:
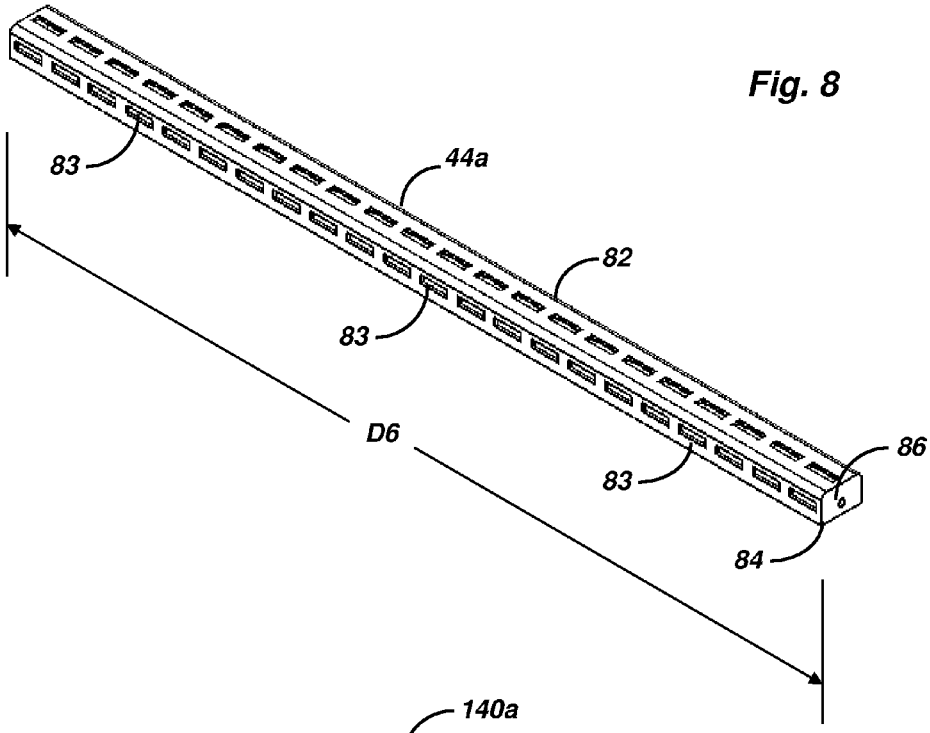
FIG. 8 is a perspective view of an extension member of the expandable platform illustrated in FIG. 5.

Referring now to FIG. 8, the extension member 44*a* will be described. While all of the illustrated extension members 44*a*-44*h* can be the same, for purposes of simplicity, only extension member 44*a* is shown in FIG. 8 and described below. The extension member 44*a* has a depth D6. In the illustrated embodiment, the depth D6 of the extension member 44*a* is in a range of from about 50.0 inches to about 80.0 inches. In other embodiments, the depth D6 of the extension member 44*a* can be less than about 50.0 inches or more than about 80.0 inches.

The extension member 44*a* includes an extended segment 82 and end plate 84. In the illustrated embodiment, the extended segment 82 has a U-shaped cross-sectional shape. However, the extended segment 82 can have other desired cross-sectional shapes. The extended segment 82 has a plurality of spaced apart slots 83 formed there through along its depth D6 and positioned on each of the U-shaped sides. In the illustrated embodiment, the end plate 84 is attached to one end of the extension member 44*a* by welding. However, the end plate 84 can be attached to one end of the extension member 44*a* by other desired methods. The end plate 84 has an aperture 86.

Referring again to embodiment illustrated in FIG. 5, the corner members 40*a*-40*d*, side members 42*a*-42*d*, and extension members 44*a*-44*h*, are formed from a lightweight material, such as for example aluminum. In other embodiments, the corner members 40*a*-40*d*, side members 42*a*-42*d*, and extension members 44*a*-44*h* can be made from other lightweights materials, including the non-limiting example of reinforced fiberglass. While in the illustrated embodiment, the corner members 40*a*-40*d*, side members 42*a*-42*d*, and extension members 44*a*-44*h* are made from the same materials, in other embodiments, the corner members 40*a*-40*d*, side members 42*a*-42*d*, and extension members 44*a*-44*h* each can be made from different materials.

Referring again to FIG. 5, the corner members 40*a*-40*d*, side members 42*a*-42*d*, and extension members 44*a*-44*h* have a wall thickness in a range of from about 0.25 inches to about 0.375 inches. Alternatively, the corner members 40*a*-40*d*, side members 42*a*-42*d*, and extension members 44*a*-44*h*, can have a wall thickness less than about 0.25 or more than about 0.375 inches.

The corner members 40*a*-40*d*, side members 42*a*-42*d*, and extension members 44*a*-44*h*, can have any desired coating or finish, including the non-limiting example of an anti-oxidizing paint.

In operation, the expandable platform 10 can be assembled in a location that is remote from a construction site and shipped as completed assembly. Alternatively, the expandable platform 10 can be shipped in an unassembled condition and subsequently assembled at a construction site. In still other embodiments, selected portions of the expandable platform 10 can be assembled and shipped to a construction site for assembly with the remaining portions. Referring again to FIG. 5, assembly of the expandable platform 10 includes the following assembly steps. First, the corner members 40*a*-40*d* are slidably attached to the side members 42*a*-42*d* such that the top edges 72*a*-72*b* of the corner members 40*a*-40*d* are positioned under the lips 50 of the side members 42*a*-42*d*. At the same time, the horizontal members 78*a*-78*b* of the corner members 40*a*-40*d* are seated against the support surface 54 of the side members 42*a*-42*d*. In this position, the corner members 40*a*-40*d* can be slid until both the depth D2 and the width W2 of the expandable platform 10 are adjusted to fit within the length and width of the elevator hoistway 22. Throughout these ranges of movement, the slots 80*a* and 80*b* of the corner members 40*a*-40*d* are aligned with the apertures 58 of the side members 42*a*-42*d*. When desired relative orientations are achieved, the corner members 40*a*-40*d* and the side members 42*a*-42*d* are connected to each other by connecting hardware (not shown) extending through the aligned slots 80*a* and 80*b* and apertures 58. The connecting hardware can be any desired, such as for example, nuts, bolts, and the like.

Referring again to FIG. 5, the extension members, 44*a*, 44*c*, 44*e*, and 44*g* are connected to the side member 42*b* by aligning the apertures 86 of the end plates 84*b* with the apertures 60 of the attachment surface 56 and using any desired connecting hardware (not shown). The extension members, 44*a*, 44*c*, 44*e*, and 44*g* are connected such that they extend toward opposing side member 42*d*. Similarly, the extension members, 44*b*, 44*d*, 44*f*, and 44*h* are connected to the side member 42*d* by aligning the apertures of the end plate 84 with the apertures 60 of the attachment surface 56 and using any desired connecting hardware (not shown). The extension members, 44*b*, 44*d*, 44*f*, and 44*h* are connected such that they extend toward opposing side member 42*b*.

As shown in FIG. 5, pairs of extension members are formed by connecting extension members from the opposing side members 42*b* and 42*d*. For example, a first pair of extension members can be formed by aligning extension member 44*a* to extension member 44*b* such that connecting hardware (not shown) can be positioned through slots 83 in the aligned extension members 44*a* and 44*b*. Similarly, a second pair of extension members can be formed by aligning extension member 44*c* to extension member 44*d* such that connecting hardware (not shown) can be positioned through slots 83 in the aligned extension members 44*c* and 44*d*. The connecting hardware can be any desired connecting hardware. The pairs of extension members are configured to support the platform surfaces 12*a* and 12*b*.

While the illustrated embodiment shows the extension members 44*a*-44*h* connected to opposing side members 42*b* and 42*d*, it should be understood that the extension members 44*a*-44*h* could be rotated and connected to opposing side members 42*a* and 42*c*.

Referring again to FIGS. 1 and 7, once the frame assembly 14 is completely assembled, the platform surfaces 12*a* and 12*b* can be installed into the frame assembly 14. The platform surfaces 12*a* and 12*b* are installed such that outer edges 13*a* and 13*b* of the platform surfaces 12*a* and 12*b* fit within the lips 76*a* and 76*b* of the corner members 40*a*-40*d*.

As the expandable platform 10 is adjustable, the expandable platform 10 can advantageously be reused in elevator hoistways having different depths and widths. The expandable platform 10 is readjusted to different sizes simply by loosening the hardware connecting the side members 42*a*-42*d* to the corner members 40*a*-40*d* and the hardware connecting the extension members 44*a*-44*h* to each other. The depth D2 and the width W2 of the expandable platform 10 are reset by sliding the corner members 40*a*-40*d* relative to the side members 42*a*-42*d* until the desired depths D2 and widths W2 are achieved. The connecting hardware is retightened and the platform surfaces 12*a* and 12*b* are reinstalled.

Figure 9:
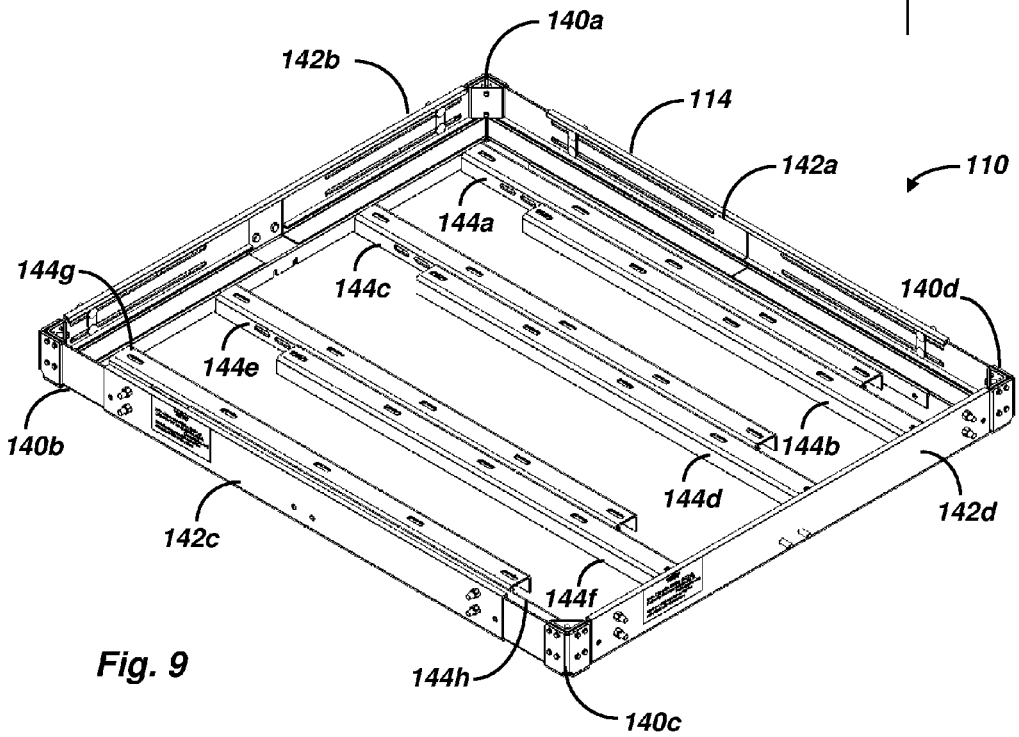
FIG. 9 is a perspective view of a second embodiment of an expandable platform shown without work surfaces.

While the expandable platform 10 described above includes corner members 40*a*-40*d* that are formed as a one-piece structure, in other embodiments, the corner members can be assembled from multiple components. Referring now to FIG. 9, a second embodiment of an expandable platform is shown generally at 110. The expandable platform 110 includes a frame assembly 114. The frame assembly 114 includes corner assemblies 140*a*-140*d*, side members 142*a*-142*d* and extension members 144*a*-144*h*. In the illustrated embodiment, the side members 142*a*-142*d* and extension members 144*a*-144*h* are the same as, or similar to, the side members 42*a*-42*d* and extension members 44*a*-44*h* illustrated in FIG. 5 and discussed above. In other embodiments, the side members 142*a*-142*d* and extension members 144*a*-144*h* can be different from the side members 42*a*-42*d* and extension members 44*a*-44*h*.

Figure 10:
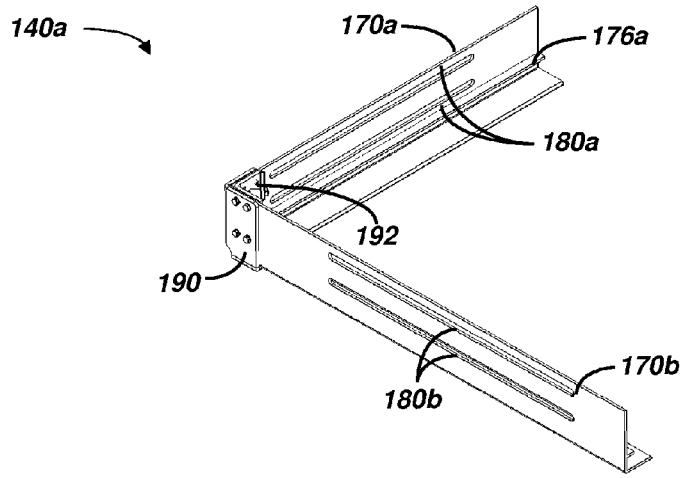
FIG. 10 is a perspective view of a corner member of the expandable platform illustrated in FIG. 9.
Figure 11:
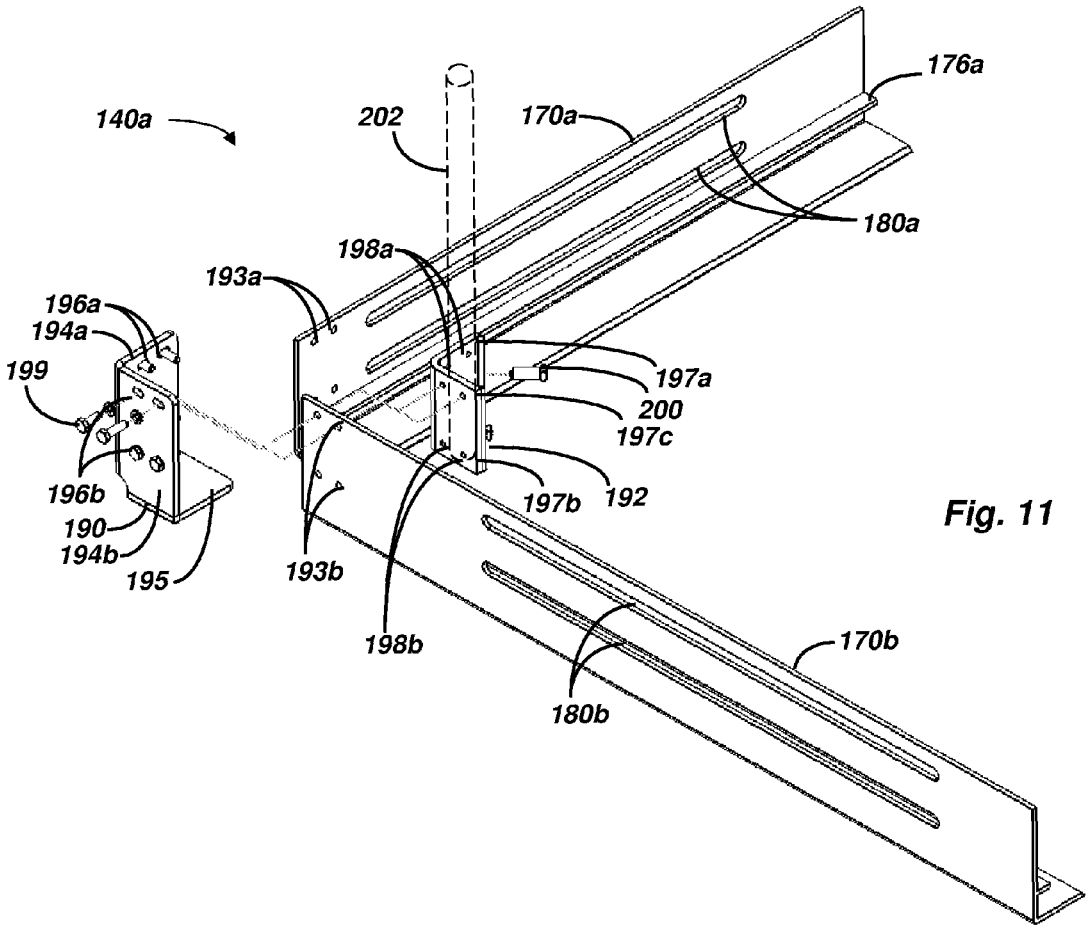
FIG. 11 is an exploded perspective view of the corner member illustrated in FIG. 10.

Referring now to FIGS. 10 and 11, corner assembly 140*a* is illustrated. Corner assembly 140*a* includes a first rail 170*a*, a second rail 170*b*, an outer bracket 190 and an inner bracket 192. The first rail 170*a* and the second rail 170*b* have the same structure as the first side 70*a* and second side 70*b* illustrated in FIG. 7 and described above including slots 180*a* and 180*b* and lips 176*a* and 176*b* (not shown). The first rail 170*a* and second rail 170*b* have a plurality of apertures 193*a* and 103*b*.

As shown in FIG. 11, the outer bracket 190 has a first side 194*a*, a second side 194*b* and a bottom 195. The first side 194*a* and the second side 194*b* connect to form an angle of approximately 90°. The bottom 195 connects to both the first side 194*a* and the second side 194*b*. The first side 194*a* includes a plurality of apertures 196*a* and similarly, the second side 194*b* includes a plurality of apertures 196*b*. Generally, the spacing and the pattern of the apertures, 196*a* and 196*b*, correspond to the spacing and pattern of the apertures 193*a* positioned in the first member 170*a* and the apertures 193*b* positioned in the second member 170*b*.

As illustrated in FIG. 11, the inner bracket 192 includes a first side 197*a*, a second side 197*b* and a third side 197*c*. The first side 197*a* and the second side 197*b* connect to form an angle of approximately 90°. The third side 197*c* spans the first and second sides, 197*a* and 197*b*, thereby forming a structure having a triangular cross-sectional shape. The first side 197*a* includes a plurality of threaded apertures 198*a* and similarly, the second side 197*b* includes a plurality of threaded apertures 198*b*. Generally, the spacing and the pattern of the apertures, 198*a* and 198*b*, correspond to the spacing and pattern of the apertures 193*a* positioned in the first rail 170*a* and the apertures 193*b* positioned in the second rail 170*b*.

Referring again to FIG. 11, assembly of the corner assembly 140*a* includes the following assembly steps. First, the first rail 170*a* and the second rail 170*b* are positioned on the bottom 195 of the outer bracket 190 such that the apertures 196*a* of the outer bracket 190 align with the apertures 193*a* of the first rail 170*a* and the apertures 196*b* of the outer bracket 190 align with the apertures 193*b* of the second rail 170*b*. Next, a threaded fastener 199 is disposed through the apertures, 196*a* and 193*a*, and threaded into the threaded aperture 198*b* of the inner bracket 192. The threaded fastener 199 is securely tightened. This process is repeated is repeated until all of the apertures 196*a* and 196*b* of the outer bracket have threaded fasteners mounted therethrough. Connecting the first rail 170*a*, the second rail 170*b*, outer bracket 190 and inner bracket 192 together forms the corner assembly 140*a*. The corner assembly 140*a* can be used to assemble the expandable platform 110 in the same manner as the corner member 40*a* discussed above.

Optionally, the third side 197*c* of the inner bracket 192 can include a threaded aperture (not shown). The threaded aperture is configured to receive a set screw 200. The set screw 200 is configured for securing an optional structure 202 within the triangular cross-sectional shape formed by the first side 197*a*, second side 197*b* and third side 197*c* of the inner bracket 192. In the embodiment shown in FIG. 11, the optional structure 202 is a pole. However, the optional structure can be any desired structure, mechanism or device.

The principle and mode of operation of this invention have been described in its preferred embodiments. However, it should be noted that this invention may be practiced otherwise than as specifically illustrated and described without departing from its scope.

What is claimed is:

1. An expandable platform for use within an elevator hoistway, the expandable platform comprising:

a plurality of corner members slidably connected to a plurality of side members, the corner members and the side members forming an adjustable frame assembly, wherein the plurality of corner members are configured as assemblies of corner brackets and rails, wherein the corner brackets include an outer corner bracket and in inner corner bracket, wherein the inner bracket is formed by a first side, a second side and a third side, wherein the first side, second side and third side form a triangular cross-sectional shape; and a plurality of extension members connected to opposing side members, the extension members configured to support a plurality of support surfaces;

wherein a depth and a width of the adjustable frame assembly can be adjusted to fit elevator hoistways having various depths and widths.

2. The corner members of claim 1, wherein the outer corner bracket includes a bottom.

3. The corner members of claim 1, wherein the third side of the inner bracket includes a threaded aperture.

4. The expandable platform of claim 1, wherein the rails of the corner members have lips configured to receive edges of the plurality of support surfaces.

5. The expandable platform of claim 1, wherein the side members include a lip.

6. The expandable platform of claim 5, wherein the corner members have top edges and the top edges of the corner members slidably fit within the lips of the side members.

7. The expandable platform of claim 1, wherein the platform is configured for use with a false car.

8. The expandable platform of claim 1, wherein the support surfaces form an opening.

9. The expandable platform of claim 8, wherein the opening is sized to allow a hoist frame to extend through the expandable platform.

* * * * *

UNITED STATES PATENT AND TRADEMARK OFFICE

CERTIFICATE OF CORRECTION

PATENT NO. : 8,141,683 B1
APPLICATION NO. : 12/766951
DATED : March 27, 2012
INVENTOR(S) : Steven P. Wurth, Terry Rodebaugh and Jeffrey A. Wagenhauser It is certified that error appears in the above-identified patent and that said Letters Patent is hereby corrected as shown below:

Column 8, Claim 1, Line 36, "in" should be -- an --.

Signed and Sealed this
Twenty-ninth Day of May, 2012

David J. Kappos

David J. Kappos
*Director of the United States Patent and Trademark Office*